US006244816B1

(12) United States Patent
Magoshi

(10) Patent No.: US 6,244,816 B1
(45) Date of Patent: Jun. 12, 2001

(54) GLAND PORTION DEFORMATION PREVENTING STRUCTURE OF LOW PRESSURE STEAM TURBINE

(75) Inventor: Ryotaro Magoshi, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/422,460

(22) Filed: Oct. 21, 1999

(51) Int. Cl.[7] ..... F01D 11/04

(52) U.S. Cl. ..... 415/109; 415/111; 415/112; 415/168.4; 415/230

(58) Field of Search ..... 415/109, 111, 415/112, 168.3, 168.4, 169.2, 169.4, 171.1, 174.5, 230

(56) References Cited

FOREIGN PATENT DOCUMENTS 0 752 515 1/1997 (EP) .
0 919 698 6/1999 (EP) .
2 594 176 8/1987 (FR) .
63-205404 * 8/1988 (JP) ..... 415/112

* cited by examiner

*Primary Examiner*—Christopher Verdier
(74) *Attorney, Agent, or Firm*—Wenderoth, Lind & Ponack, L.L.P.

(57) ABSTRACT

A structure for preventing deformation of a gland portion of a low pressure steam turbine by preventing wet steam from entering the gland portion. The gland portion includes a gland casing (3) that surrounds a gland portion periphery (2) of a rotor (1). A portion of steam (20), in the form of wet steam **(21*a*), flows into a cavity (10) through a gap (11). Accordingly, a ridge (15) is provided on and around the entire periphery of the rotor (1), and thereby the wet steam (21*a*) is caused to flow in a swirling manner, and is prevented from flowing toward the gland portion periphery (2). Also, water in the wet steam (21*a*) scatters therearound so that the gland casing (3) and the seal portion (4, 5) are prevented from being partially cooled. Thus, contact with the rotor (1)** is avoided and vibration caused thereby is prevented.

7 Claims, 3 Drawing Sheets

GLAND PORTION DEFORMATION PREVENTING STRUCTURE OF LOW PRESSURE STEAM TURBINE

BACKGROUND OF THE INVENTION

1. Field of the Invention

The present invention relates generally to a gland portion deformation preventing structure of a low pressure steam turbine and more particularly to a structure for preventing thermal deformation of the gland portion that is exposed to wet steam coming from an exhaust chamber.

2. Description of the Prior Art

FIG. 3 is a cross sectional view of a half portion of a double flow type low pressure steam turbine, which is known in the prior art. In FIG. 3, numeral 1 designates a rotor and numeral 2 designates a gland portion periphery of the rotor 1. Numeral 3 designates a gland casing, which surrounds the gland portion periphery 2 of the rotor 1. Within the gland casing 3, there is formed a passage (not shown) through which sealing steam for sealing the gland portion periphery 2 flows in or flows out. Numerals 4, 5 designate a seal portion, which comprises a labyrinth seal, etc. and is disposed so as to oppose the gland portion periphery 2. Thus, a gland portion is formed by the gland portion periphery 2 of the rotor 1, the gland casing 3 and the seal portion 4, 5.

Numeral 6 designates a casing, which forms therein an exhaust chamber 7. Numeral 8 designates a final stage stationary blade and numeral 9 designates a final stage moving blade. Numeral 10 designates a cavity, which is formed annularly between the exhaust chamber 7 and the rotor 1. Two apparatuses consisting each of the mentioned parts and components are disposed symmetrically in the right and left direction of the rotor 1 in the figure and steam 20 flows therein from the central portion to flow separately into steam paths of the right and left blade portions for rotation of the respective rotors 1.

That is, in the low pressure steam turbine constructed as mentioned above, the steam 20 of low pressure flows into the turbine portions from the central portion to flow through the steam paths wherein stationary blades and moving blades are disposed in multi-stages, including the final stage stationary blade 8 and the final stage moving blade 9. While the steam 20 so flows through the steam paths, it works to rotate the rotor 1 and then flow out into the exhaust chamber 7 and further into a condenser (not shown) to be condensed to water.

In the mentioned low pressure steam turbine, in order to seal an inside of the casing 6, where the steam flows, against an outside thereof in the gland portion periphery 2 of the rotor 1 at a downstream end portion of the casing 6, sealing steam is led into the gland casing 3 to maintain a predetermined pressure therein and then the sealing steam flows out into the cavity 10 via the seal portion 4, 5, as shown by the arrows which indicate the steam 22. Thereby the steam in the casing 6 is prevented from leaking outside along the gland portion periphery 2.

On the other hand, while the steam, which has passed through the final stage stationary blade 8 and moving blade 9 and finished its work, flows out into the exhaust chamber 7, a portion of the steam in the form of wet steam 21 may enter the cavity 10 through a gap 11 between the rotor 1 and a stationary portion of the exhaust chamber 7, etc. This wet steam 21, which has finished the work, is a low temperature steam having a high moisture content and cools portions of the seal portion 4, 5 and the gland casing 3 which are heated by the sealing steam in the vicinity of the gland portion in order to cause deformation of the gland casing 3, which, according to the extent of the deformation, causes the seal portion 4, 5 to come into excessive contact with the gland portion periphery 2 of the rotor 1 so as to generate vibration there.

As mentioned above, in the prior art gland portion of the low pressure steam turbine, the wet steam 21 that has finished the work may enter the gland portion via the cavity 10 and partially cool the gland casing 3 and the seal portion 4, 5 so as to cause the deformation of the gland portion, by which there arises the problem that the rotor 1 and the seal portion 4, 5 make excessive contact with each other, as the case may be, thereby generating vibration at this location.

SUMMARY OF THE INVENTION

In view of the problem in the prior art, it is an object of the present invention to provide a countermeasure in a low pressure steam turbine for preventing wet steam, which may enter a cavity upstream of a gland portion, from further entering the gland portion so that a gland casing and a seal portion will not be cooled by the wet steam.

In order to achieve the mentioned object, the present invention provides the following means.

A gland portion deformation preventing structure of a low pressure steam turbine that is of a type in which a gland portion comprising a seal device and a gland casing for leading therein a sealing steam is provided between a rotor and an exhaust chamber and a wet steam flowing from the exhaust chamber through a gap at a base portion of a final stage moving blade is prevented from leaking outside from the gland portion. The present invention is characterized in that there is provided a ridge projecting in a predetermined width and height on and around an entire periphery of said rotor at a position between the gland portion of the rotor and the gap at the base portion of the final stage moving blade such that the wet steam flowing through the gap is prevented from flowing toward the gland portion so that deformation of the gland portion due to cooling by the wet steam may be prevented.

Also, the ridge has a cross sectional shape in a plane passing through an axis of the rotor of any one of a shape having smooth curved lines descending toward both sides from a top thereof, a semi-circular shape, a triangular shape having one apex in a top thereof and a quadrangular shape.

In the gland portion deformation preventing structure according to the present invention, there is provided the projecting ridge having a predetermined width and height on and around the entire periphery of the rotor at the position between the gap at the moving blade base portion and the gland portion and the wet steam which is going to enter the rotor side from the exhaust chamber side through the gap to flow toward the gland portion, which includes the gland casing and the seal portion, and strike the ridge of the rotor. Also, there is a centrifugal effect following the rotation of the rotor, and thereby the wet steam flows in a swirling pattern in front of the ridge and does not reach the gland portion. Also, water in the wet steam, attached to the ridge, scatters therearound due to the rotation of the rotor before it reaches the gland portion and is discharged outside via a drain.

In the prior art gland portion, the wet steam flows into the gland casing and the seal portion of the gland portion, and thereby the gland portion, which is heated by the sealing steam is partially cooled by the water contained in the wet steam to cause a deformation thereof so that the seal portion and the rotor may contact excessively with each other to generate vibration. In the present invention, the ridge is provided, and thereby the wet steam is prevented from flowing to the gland portion and the vibration caused by the deformation of the gland portion can be prevented.

DESCRIPTION OF THE PREFERRED EMBODIMENTS

Figure 1:
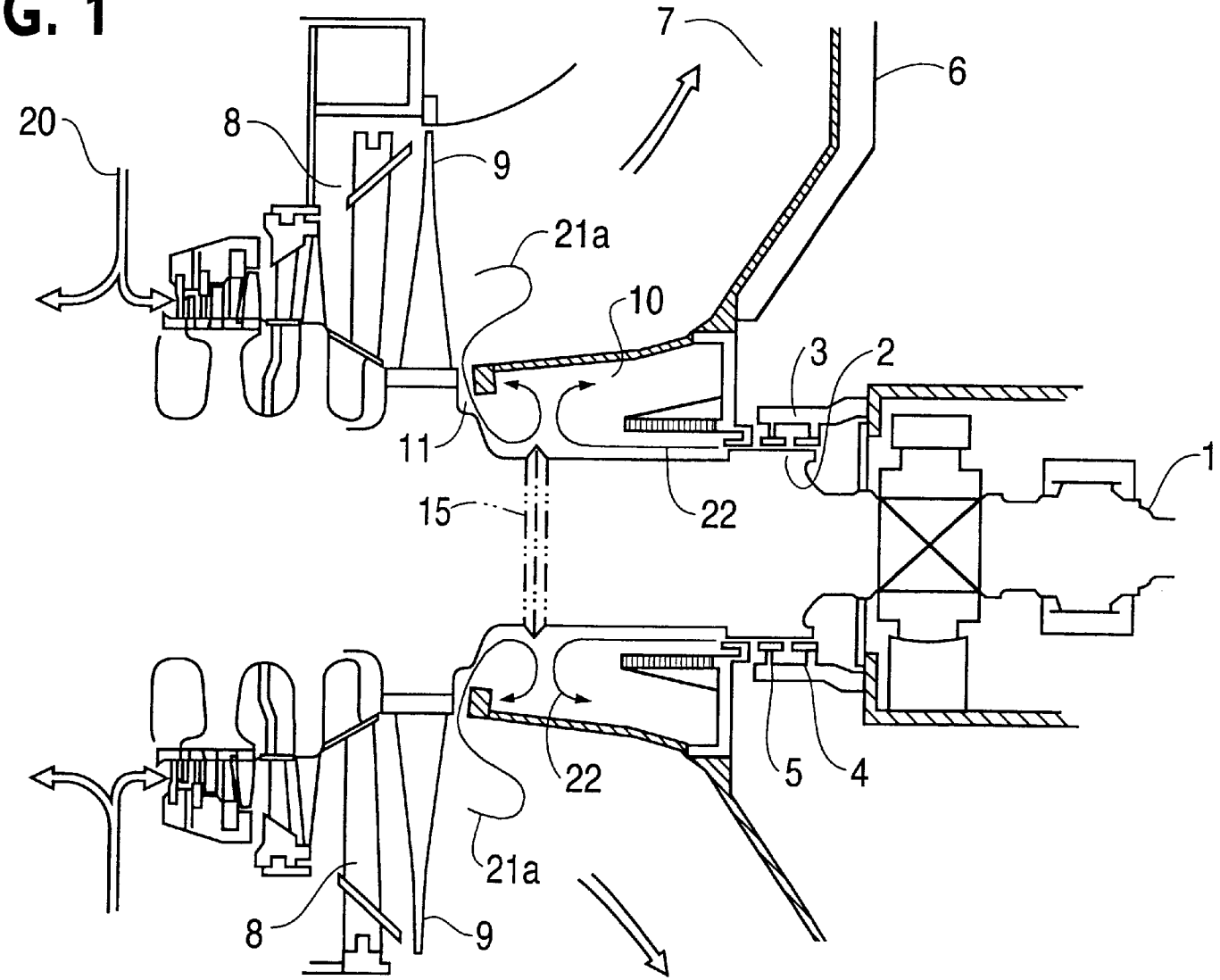
FIG. 1 is a cross sectional view of a half portion of a double flow type low pressure steam turbine having a gland portion deformation preventing structure constructed in accordance with an embodiment of the present invention.
Figure 2A:
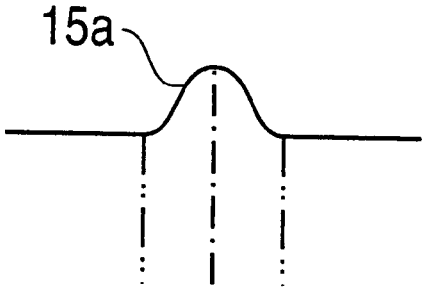
FIGS. 2(*a*)–(*d*) show various forms of a ridge cross sectional shape in a plane passing through a rotor axis with respect to the gland portion deformation preventing structure of the embodiment shown in FIG. 1, wherein FIG. 2(*a*) is a shape having smooth curved side lines, FIG. 2(*b*) is a semi-circular shape, FIG. 2(*c*) is a triangular shape and FIG. 2(*d*) is a quadrangular shape.
Figure 2B:
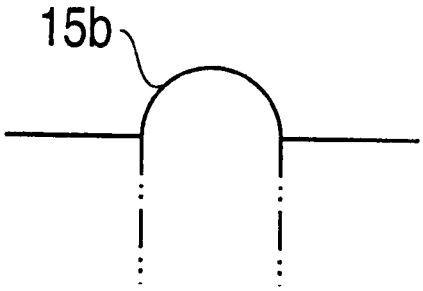
Figure 2C:
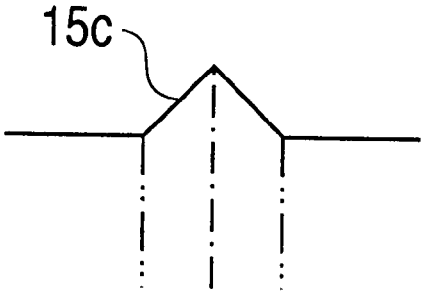
Figure 2D:
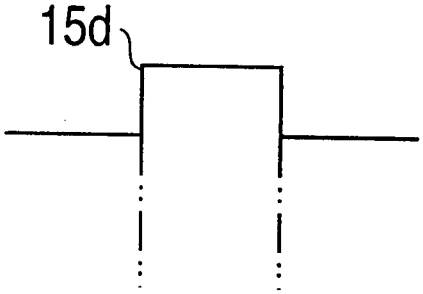
Figure 3:
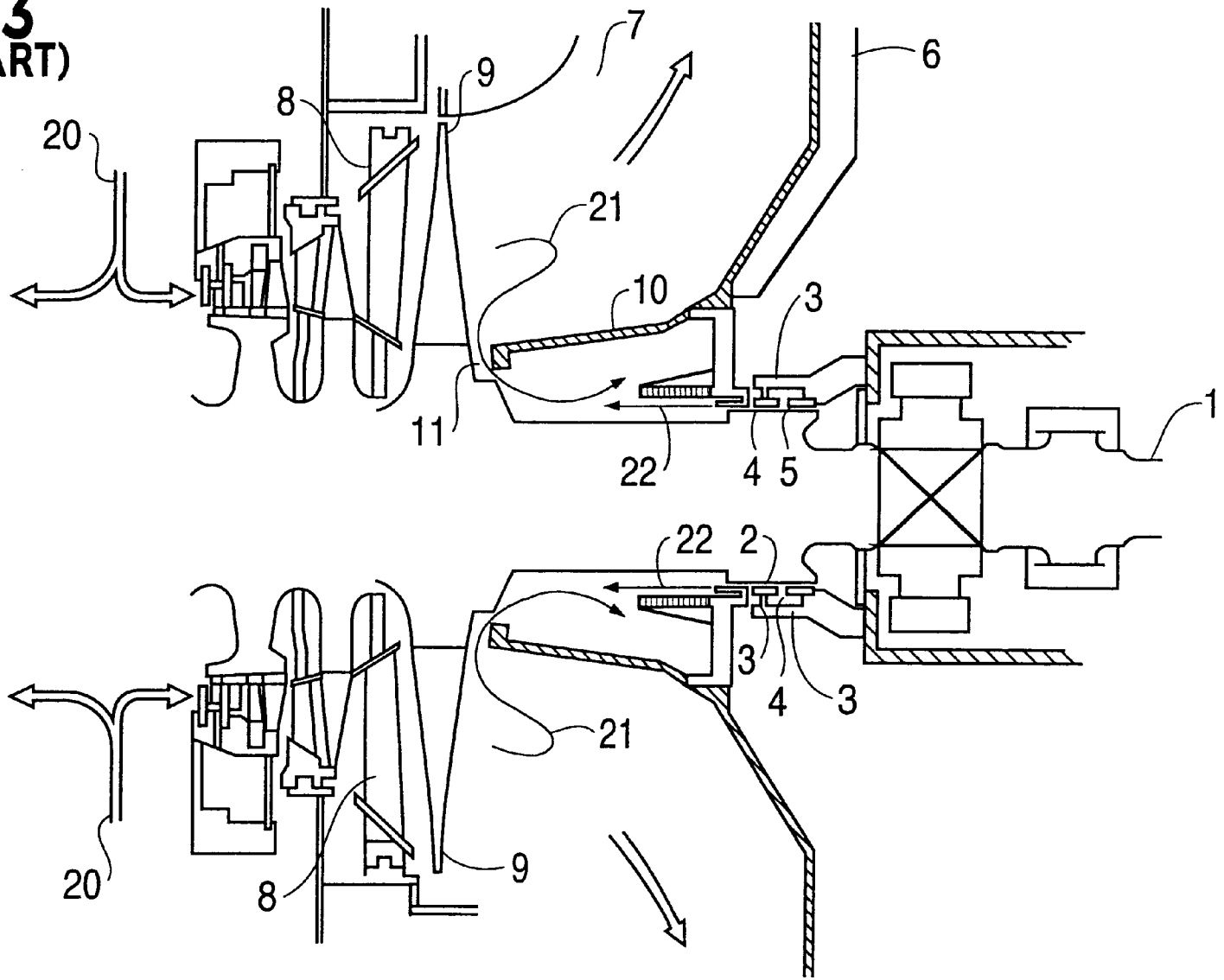
FIG. 3 (PRIOR ART)
FIG. 3 is a cross sectional view of a half portion of a prior art double flow type low pressure steam turbine.

Herebelow, embodiments according to the present invention will be described with reference to figures. FIG. 1 is a cross sectional view of a half portion of a double flow type low pressure steam turbine having a gland portion deformation preventing structure of an embodiment according to the present invention. In FIG. 1, those parts and components designated by numerals 1 to 10, 20 and 22 are the same as those in the prior art shown in FIG. 3, and are referred to with the same reference numerals, and thus detailed description thereof is omitted. Also, a ridge designated by reference numeral 15, which is a featured portion of the present invention, will be described in detail.

In FIG. 1, the ridge 15 is provided on and around an entire periphery of the rotor 1 at a position near the gap 11 between a base portion of the moving blade 9 and a stationary portion of the exhaust chamber 7, etc. in the cavity 10 formed between the gland portion periphery 2 of the rotor 1 and the gap 11 at the base portion of the final stage moving blade 9.

Referring to FIGS. 2(*a*)–(*d*), as a cross sectional shape in a plane passing through an axis of the rotor 1, the projecting ridge 15 may have any one of a shape 15*a* having smooth curved lines descending toward both sides from a top thereof, as shown in FIG. 2(*a*), a semi-circular shape 15*b*, as shown in FIG. 2(*b*), a triangular shape 15*c* having one apex in a top thereof, as shown in FIG. 2(*c*) and a quadrangular shape 15*d*, as shown in FIG. 2(*d*). The point is to select a shape of the ridge that has good workability.

In the low pressure steam turbine of FIG. 1 constructed as mentioned above, steam 20 entering the turbine from a central portion thereof flows separately in the right and left directions to flow through steam paths formed by stationary blades and moving blades that are disposed in multi-stages, including the final stage stationary blade 8 and moving blade 9. While the steam 20 so flows through the steam paths, it works to rotate the rotor 1 and then becomes a low temperature steam. This low temperature steam flows out into the exhaust chamber 7 to be then led into a condenser (not shown) to be condensed to water.

In the mentioned low pressure steam turbine, in order to seal an interior of the casing 6 against an outside thereof along the gland portion periphery 2 of the rotor 1 in a downstream end portion of the casing 6, sealing steam is led into the gland casing 3 to maintain a predetermined pressure therein and then to flow out into the cavity 10 via the seal portion 4, 5, as shown by the arrows indicating steam 22. Thereby, the steam in the casing 6 is prevented from leaking outside along the gland portion periphery 2.

The steam 22 enters the cavity 10 and strikes the ridge 15, which then causes a swirling flow, as shown by the arrows indicating the steam 22.

On the other hand, while the steam, which has passed through the final stage stationary blade 8 and moving blade 9 and finished its work, flows out into the exhaust chamber 7, a portion of that steam in the form of wet steam 21*a* may enter the cavity 10 through the gap 11 between the rotor 1 and a stationary portion of the exhaust chamber 7, etc.

The wet steam 21*a* entering the cavity 10 through the gap 11 strikes the ridge 15, which has a predetermined width and height and projects on and around the entire periphery of the rotor 1, and is prevented from flowing toward the gland portion periphery 2. Also, due to a centrifugal effect of flow following the rotation of the rotor 1, the flow of wet steam 21*a* swirls as shown FIG. 1. Accordingly, water in the wet steam 21*a* attaching to the ridge 15 scatters therearound due to the rotation thereof.

Further, the sealing steam 22 swirling in the cavity 10, as mentioned above, prevents the wet steam 21*a* in the cavity 10 from flowing over the ridge 15 toward the gland portion periphery 2, and hence the mentioned swirling flow due to the centrifugal effect can be promoted further.

In the present embodiments as described above, the projecting ridge 15 is provided in a predetermined width and height on and around the entire periphery of the rotor 1 in the cavity 10 formed by the base portion of the final stage moving blade 9 and the casing 6, and thereby the wet steam 21*a* entering the cavity 10 through the gap 11 is prevented from flowing toward the gland portion periphery 2. Also, water in the wet steam 21*a* attaching to the ridge 15 scatters due to the rotation of the rotor 1, and the gland casing 3 and the seal portion 4, 5 are prevented from being partially cooled.

As a summary of the effect of the present invention, i.e. the gland portion deformation preventing structure of a low pressure steam turbine, the low pressure steam turbine is of a type in which a gland portion, comprising a seal device and a gland casing for leading therein a sealing steam, is provided between a rotor and an exhaust chamber and a wet steam flowing from said exhaust chamber through a gap at a base portion of a final stage moving blade is prevented from leaking outside from the gland portion. The present invention is characterized in that there is provided a ridge projecting in a predetermined width and height on and around an entire periphery of said rotor at a position between the gland portion of the rotor and the gap at the base portion of the final stage moving blade and the wet steam flowing through the gap is prevented from flowing toward the gland portion so that deformation of the gland portion due to cooling by the wet steam may be prevented.

By use of such structure, the wet steam which is going to come into the rotor side from the exhaust chamber side to flow toward the gland portion strikes the ridge of the rotor, and thereby the wet steam is prevented from flowing to the gland portion, thereby no partial cooling of the gland casing the seal portion can take place so that a deformation of the gland portion may be prevented and no vibration due to contact with the rotor side is caused.

It is understood that the invention is not limited to the particular construction and arrangement herein described and illustrated but embraces such modified forms thereof as come within the scope of the appended claims.

What is claimed is:

1. A gland portion deformation preventing structure of a low pressure steam turbine, said low pressure steam turbine being of a type in which a gland portion comprising a seal device and a gland casing for leading therein a sealing steam is provided between a rotor and an exhaust chamber and a wet steam flowing from said exhaust chamber through a gap at a base portion of a final stage moving blade is prevented from leaking outside from said gland portion, wherein there is provided a ridge projecting in a predetermined width and height on and around an entire periphery of said rotor at a position between said gland portion of the rotor and said gap at the base portion of the final stage moving blade and said wet steam flowing through said gap is prevented from flowing toward said gland portion so that a deformation of said gland portion due to cooling by said wet steam may be prevented.

2. A gland portion deformation preventing structure of a low pressure steam turbine as claimed in claim 1, wherein said ridge has a cross sectional shape in a plane passing through an axis of said rotor of any one of a shape having smooth curved lines descending toward both sides from a top thereof, a semi-circular shape, a triangular shape having one apex in a top thereof and a quadrangular shape.

3. A low pressure steam turbine comprising:

a rotor;

a final stage moving blade connected to said rotor and having a base portion;

an exhaust chamber disposed downstream of said final stage moving blade, wherein a gap is defined between said exhaust chamber and said base portion of said final stage moving blade;

a gland portion comprising a seal device and a gland casing, said galand portion being adapted to direct sealing steam into an area between said rotor and said exhaust chamber; and an annular ridge projecting radially outwardly from and outer peripheral surface of said rotor, said ridge being positioned between said gap and said gland portion, and said ridge extending around the entire periphery of said rotor and having a predetermined width and height, wherein wet stream flowing through said gap is prevented from flowing toward said gland portion so that deformation of said gland portion due to cooling thereof by said wet steam can be prevented.

4. A low pressure steam turbine as claimed in claim 3, wherein said ridge has a cross sectional shape, taken in a plane passing through a longitudinal axis of said rotor, defined by smooth curved lines descending in opposite directions from a top of said ridge.

5. A low pressure steam turbine as claimed in claim 3, wherein said ridge has a semi-circular cross sectional shape with respect to a plane passing through a longitudinal axis of said rotor.

6. A low pressure steam turbine as claimed in claim 3, wherein said ridge has a triangular cross sectional shape with respect to a plane passing through a longitudinal axis of said rotor, the triangular shape having an apex at the radially outermost portion of said ridge.

7. A low pressure steam turbine as claimed in claim 3, wherein said ridge has a quadrangular cross sectional shape with respect to a plane passing through a longitudinal axis of said rotor.

* * * * *